United States Patent [19]

Kosak et al.

[11] Patent Number: 4,473,861

[45] Date of Patent: Sep. 25, 1984

[54] CONTROL DEVICE FOR AN ELECTROMAGNETIC CONSUMER IN A MOTOR VEHICLE, IN PARTICULAR A MAGNETIC VALVE OR AN ADJUSTING MAGNET

[75] Inventors: Wolfgang Kosak, Möglingen; Hans Kubach, Korntal-Münchingen, both of Fed. Rep. of Germany

[73] Assignee: Robert Bosch GmbH, Stuttgart, Fed. Rep. of Germany

[21] Appl. No.: 411,714

[22] Filed: Aug. 25, 1982

[30] Foreign Application Priority Data

Oct. 8, 1981 [DE] Fed. Rep. of Germany ..... 3139987

[51] Int. Cl.[3] ..... H01H 47/32

[52] U.S. Cl. ..... 361/152; 361/154; 123/490

[58] Field of Search ..... 261/152, 154; 123/490

[56] References Cited

U.S. PATENT DOCUMENTS

| | | | |
|---|---|---|---|
| 4,040,397 | 8/1977 | Leichle | 123/490 |
| 4,293,888 | 10/1981 | McCarty | 361/152 |
| 4,339,781 | 7/1982 | Harsch et al. | 123/490 X |
| 4,345,296 | 8/1982 | Breitling | 123/490 X |

*Primary Examiner*—E. A. Goldberg
*Assistant Examiner*—Derek Jennings
*Attorney, Agent, or Firm*—Edwin E. Greigg

[57] ABSTRACT

A control device is proposed for an electromagnetic engine valve or an electromagnetic final control element. The control device operates with closed-loop current control, and the maximum current is ascertained via a measuring resistor located in series with a switching transistor, while the free-running circuit is controlled in accordance with time. This control in accordance with time is effected via a comparator having dynamic positive feedback and acting as a comparison stage. The free-running control circuit includes a diode for protective purposes switched parallel to a transistor.

6 Claims, 14 Drawing Figures

CONTROL DEVICE FOR AN ELECTROMAGNETIC CONSUMER IN A MOTOR VEHICLE, IN PARTICULAR A MAGNETIC VALVE OR AN ADJUSTING MAGNET

BACKGROUND OF THE INVENTION

The invention is based on a control device as generally described hereinafter. German Offenlegungsschrift No. 27 06 436 discloses an apparatus for current-regulated triggering of electromagnetic switching systems. In the exemplary embodiment therein described, an electromagnetic injection valve is supplied at the beginning with a high current, which is subsequently clocked in the vicinity of the holding current for the magnetic valve. An extremely high expenditure for components is required in order to realize this embodiment. It is one of the objects of the invention to discover a control device which is relatively simple in structure yet nevertheless produces very good results.

OBJECT AND SUMMARY OF THE INVENTION

The control device according to the invention for an electromagnetic consumer having the characteristics described hereinafter not only requires a minimal expenditure for components but also exhibits very good signal behavior. As a result of this minimal expense, this control device is also less vulnerable to malfunctioning than the prior art.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figures 1A, 1B, 1C:
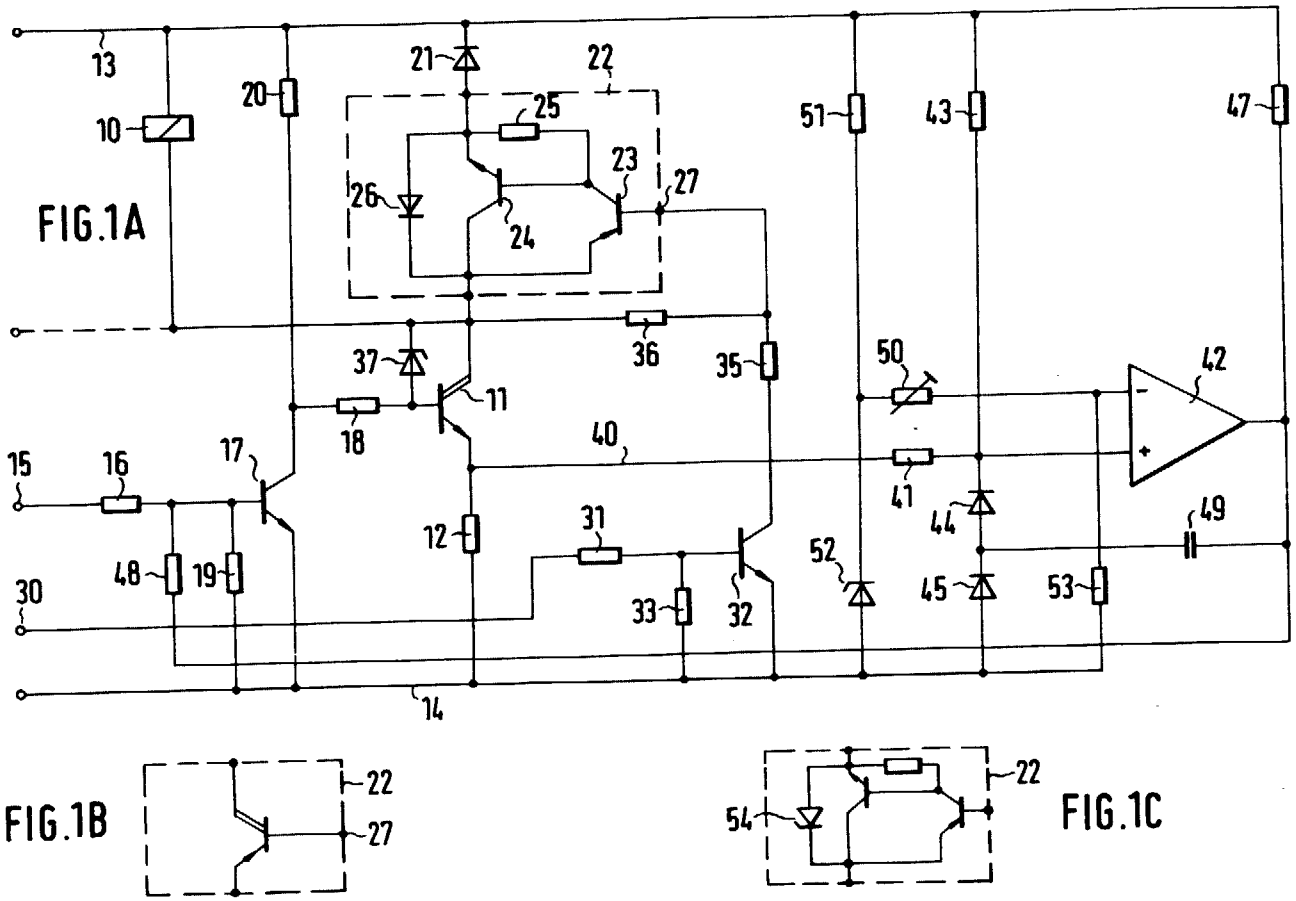
FIG. 1A, FIG. 1B and FIG. 1C show a control device for an electromagnetic injection valve.

The exemplary embodiments relate to so-called current regulated end stages, either combined with an electromagnetic injection valve in an internal combustion engine having externally supplied ignition or combined with an adjusting magnet, for instance for adjusting the quantity of fuel to be injected in a Diesel engine. In FIG. 1*a*, 10 indicates the winding of an electromagnetic injection valve, which is located in series with a switching transistor 11 and a measuring resistor 12 between two operating voltage lines 13 and 14. The switching transistor is triggered based on an input terminal 15 via a resistor 16, a transistor 17, and a further resistor 18. While the base of the transistor 17 is coupled via a resistor 19 with the ground line 14, its collector is connected via a resistor 20 with the positive line 13. Parallel to the winding 10 of the magnetic valve, a diode 21 is located in series with a free-running control circuit 22. The control circuit 22 includes two transistors 23 and 24, a resistor 25 and a diode 26. Both the diode 26 and the emitter-collector path of the transistor 24 are located between the input and output connections of the free-running control circuit 22. Parallel to the base-collector path of the transistor 24 is the emitter-collector path of the transistor 23, the base connection of which is coupled with a control input 27 of the free-running control circuit 22. The resistor 25 within this control circuit 22 finally connects the base connection to the emitter connection of the transistor 24.

While the inverted injection signal from a preceding signal generator circuit, not shown, is present at the input terminal 15, an input terminal 30 receives the non-inverted injection signal. The input terminal 30 is connected via a resistor 31 with a driver transistor 32, the emitter of which is coupled directly with the ground line 14, the base of which is coupled indirectly via a resistor with the ground line 14, and the collector of which is collected via a resistor 35 to the control input 27 of the free-running control circuit 22. A resistor 36 finally also connects the control input 27 and the collector of the switching transistor 11, from which a Zener diode 37 is connected in turn with its base.

A measurement signal line 40 leads from the connection of the measuring resistor 12 on the transistor side via a resistor 41 to the positive input of a comparator 42 acting as a threshold value switch. This positive input is furthermore connected via a resistor 43 with the positive line 13 and via a series circuit of two diodes 44 and 45 with the ground line 14. From the output of the comparator 42, a resistor 47 leads to the positive line 13, a resistor 48 leads to the base of the transistor 17 and a capacitor 49 leads to the connecting point of the two diodes 44 and 45. Its negative input is connected via resistor 50 to the connecting point of a resistor 51 and a Zener diode 52 between the two voltage passage connections. It is furthermore connected via resistor 53 to the ground line 14.

While FIG. 1*a* shows the overall circuit diagram, FIGS. 1*b* and 1*c* show further possibilities for the realization of the free-running control circuit 22. According to FIG. 1*b*, the free-running control circuit comprises solely a Darlington circuit layout without any further circuit elements. FIG. 1*c*, in contrast, shows a basically identical layout to that of FIG. 1*a*, but with the exception of the diode 26, which in the layout of FIG. 1*c* is replaced with a Zener diode 54. When the circuit layout shown in FIG. 1*c* is used, then the Zener diode 34 and the resistor 18 in the base line leading to the transistor 11 of the subject of FIG. 1*a* can both be omitted.

The mode of operation of the control apparatus shown in FIG. 1 will now be explained with the aid of the pulse diagrams of FIGS. 2 and 3.

Figure 2A:
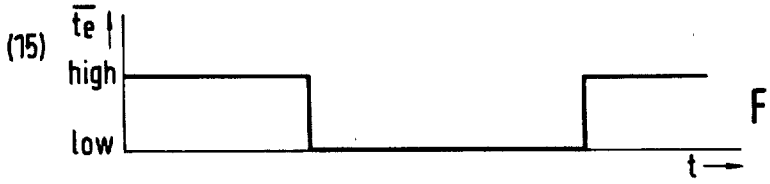
FIG. 2A–FIG. 2E and FIG. 3A–FIG. 3D are pulse diagrams explaining the subject of FIG. 1.
Figure 2B:
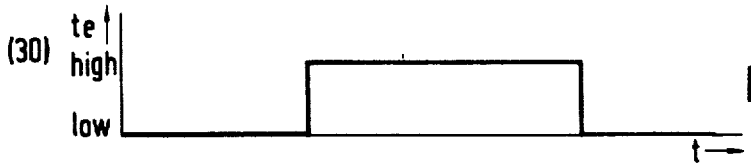
Figure 2C:
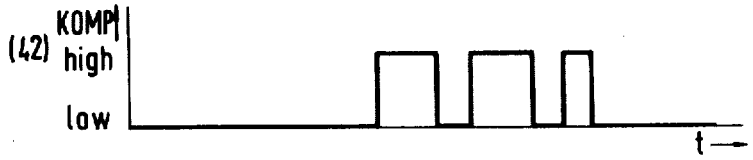

The injection signal for the electromagnetic injection valve arriving from a pulse generator stage is shown in inverted form in FIG. 2*a* and in non-inverted form in FIG. 2*b*. FIG. 2*c* characterizes the signal at the output of the comparator 42. The signal of FIG. 2*d* arises at the collector of the switching transistor 11, and the corresponding current flow through the switching transistor results in a magnetic valve current as shown in FIG. 2*e*.

The signal relationships in the area around the comparator 42 are shown in FIG. 3. There, the voltage dropping across the measuring resistor 12 is shown in FIG. 3*a*; FIG. 3*b* shows the current flow through the diode 44. A signal according to FIG. 3*c* is produced at the positive input of the comparator 42, and the output potential of this comparator 42 is shown in FIG. 3*d*.

In detail, the circuit layout shown in FIG. 1 functions as follows:

At the base of the transistor 17, the inverted injection signal of FIG. 2*a* and the output signal of the comparator (3*d*) are linked in a NOR function. As a result, the transistor 17 is conductive when there is a high signal level at the input terminal 15; as a result, the switching transistor 11 is blocked and the magnetic valve winding 10 is without current.

At the beginning of the injection signal, if the output value of the comparator 42 is low, the transistor 17 is blocked and the subsequent switching transistor 11 is controlled such that it is conductive. A current flows through the magnetic winding 10, the switching transistor 11, and the measuring resistor 12, at which a voltage proportional to the current drops. Upon attaining an adjustable upper and a lower threshold, the comparator switches its output level over. In synchronism with this internal regulating frequency, the magnetic valve winding 10 is switched to ground and the valve current is regulated between the values $I_{max}$ and $I_{min}$ (see FIG. 2*e*).

Figure 2D:
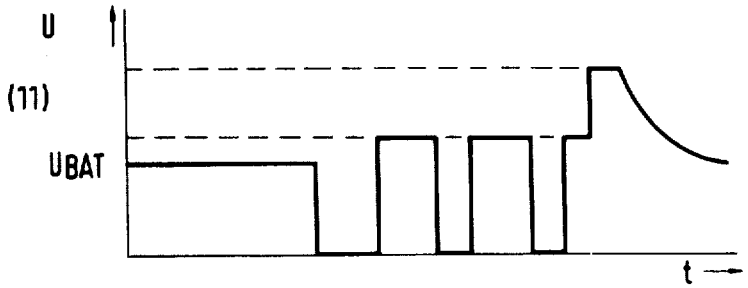
Figure 2E:
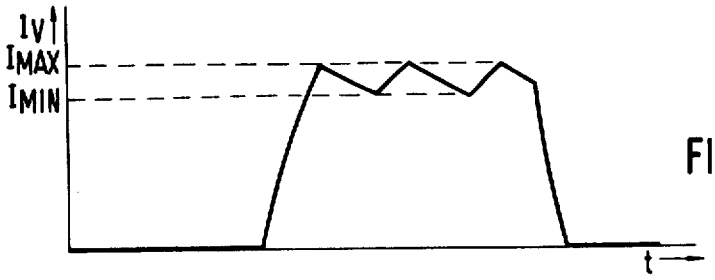

Additionally, at the end of the injection signal or in other words at the leading edge of the signal of FIG. 2*a*, the magnetic current is rapidly dropped to zero via a BC-terminal by means of interrupting the free-running control circuit (see FIG. 2*d*, in combination with the rapid signal drop at the end of the curve shown in FIG. 2*e*).

The free-running control circuit 22 is controlled to be conductive or blocked in accordance with the injection signal present at the input terminal 30. Before the appearance of an injection signal, the free-running control circuit is blocked. Only during the current intervals of the switching transistor 11 do the transistors 23 and 24 in the free-running control circuit 22 become conductive; the current through the magnetic valve winding then flows through the transistor 24 and the diode 21 and fades, beginning at the maximum current value.

During the instants of switchover of the comparator 42 from a low to a high potential, the two transistors 11 and 24 are simultaneously conductive because of the finite blocking delay times. An inverse current flows through the diode 21 and the transistors 23 and 24, and because the diode 21 has not yet attained blocking capacity, the transistors 23 and 24 assume the voltage. Since the collector-base diode of the transistor 24 is likewise still conductive, the inverse breakthrough voltage (UEB=7 V . . . 9 V) builds up between the emitter and the base during the period of the blocking delay time of the diode 21 (Fast Recovery Diode trr=200 . . . 600 ns, dependent on the blocking layer temperature and the current in the forward direction). This operating status is generally not permissible and may cause an impairment of the amplification characteristics of the two transistors 23 and 24. In order to avoid such a condition, a diode 26 is located parallel with the transistor 24. During the switchover instant, this diode 26 takes on the reverse current and limits the reverse voltage to approximately 1 volt.

In circuits in which for reasons of cooling the diode 21 is disposed between the transistors 11 and 24, the diode 26 furthermore also protects the base-emitter path of the transistor 24 from an excessively high inverse breakthrough voltage when the transistors 32 and 23 switch on.

If the diode 26 is realized as a Zener diode 54 in accordance with the circuit layout shown in FIG. 1*c*, then the quenching of the switching stage (BC-terminal) is shifted into the free-running circuit. Given a switching transistor 11 blocking at a sufficiently high level, the Zener diode 37 and the resistor 18 can then also be eliminated.

The pulse power loss of the transistor 24 can be reduced if the voltage passed through by the diode 6 is approximately 0.6 times the breakthrough voltage of the Zener diode 37. The comparator 42 operates with asymmetrical current measurement. During the periods that the switching transistor 11 is ON, the current through the magnetic winding 10 of the injection valve is ascertained via the measuring resistor 12 and fed as an actual value to the positive input of the comparator 42. The set-point value is derived from a stabilized voltage (Zener diode 52). The associated voltage divider (the resistors 50 and 53) in its comparison determines the upper switching threshold $I_{max}$.

Figure 3A:
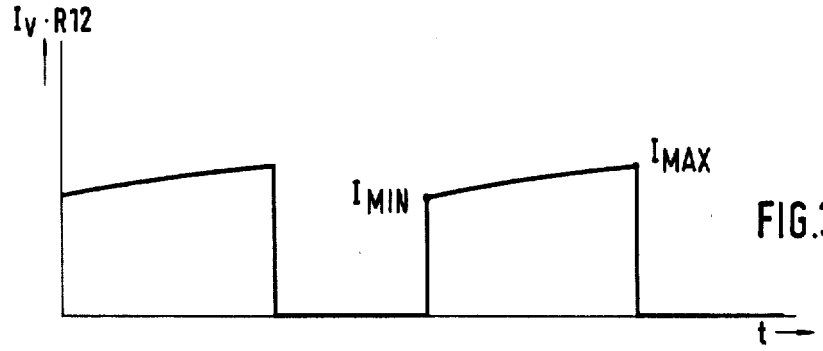
Figure 3B:
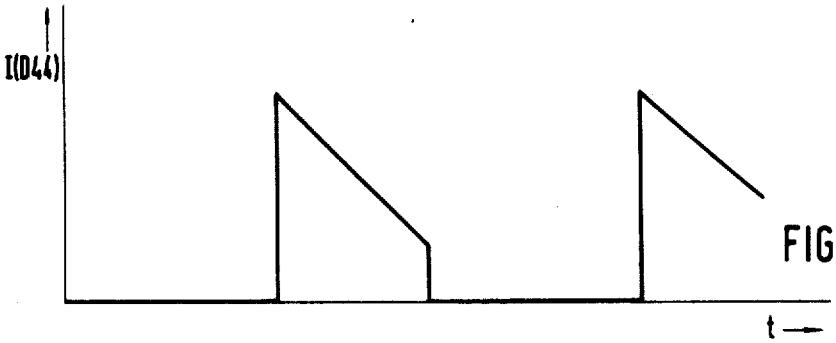
Figure 3C:
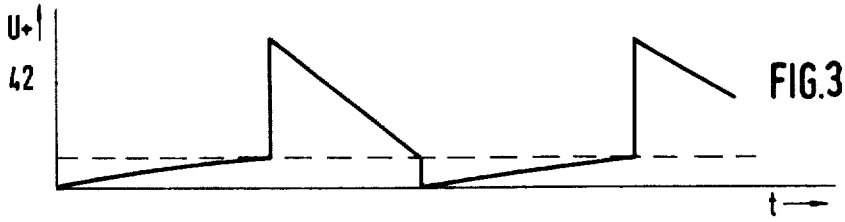
Figure 3D:
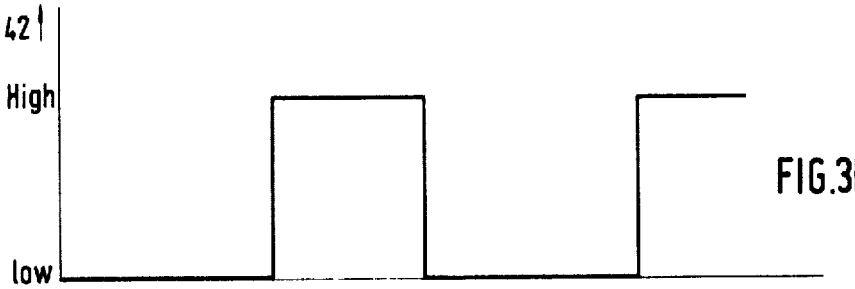

As soon as the actual voltage (U+) is equal to the set-point voltage (U−), the comparator switches from low output potential to high output potential (FIG. 3*d*).

The voltage jump is transmitted via the capacitor 49 and fades with the time constant $\tau = C(49) \times R(41)$ during the free-running phase. As soon as the voltage has again fallen below the switching threshold, the comparator 42 switches its output signal back to a low value. Then the diode 44 is blocked, so that as shown in FIG. 3*c*, the voltage at the positive input makes a small negative jump and thus contributes to the accelerated switchover of the comparator 42. The diode 45 causes the charge time of the capacitor 49 during the current-conductive phase of the transistor 11 to be substantially zero, so that in the following free-running phase it is always the same charge which is switched over in the capacitor 49. The voltage at the anode of the diode 44 additionally undergoes a limitation to approximately −0.6 volts.

Because of the circuit layout of the comparator 42, the switchover of the transistor 11 from a conductive to a blocked state when the current is at a maximum level is effected entirely freely of dynamic components because of the blocked diode 44 (FIG. 3*b*). The influence of battery voltage on the opening time of the magnetic valve is notably reduced thereby.

As a particular distinguishing feature, the circuit includes a comparing resistor 43, which compensates for the battery voltage course of the Zener diode 52 over a wider range. The Zener voltage varying at the inverting comparator input is thereby countered by an approximately equally great variation (by means of resistor 43) at the non-inverting comparator input, so that a compensation for the battery voltage course occurs. The resulting battery voltage course of the circuit layout, and in particular of the upper switching point $I_{max}$ is improved to an extraordinary degree as a result.

What is important in the circuit layout shown in FIG. 1 is the fact that during an injection signal (FIG. 2*b*), the switchoff instants of the transistor 11 are determined by the attainment of a maximal current, and the individual blocked phases of the transistor 11 orient themselves to the switchover time constant of the capacitor 49. In the abovedescribed control device combined with an electromagnetic injection valve, the object was to open a magnetic valve rapidly and then to clock the valve current, for reasons having to do with output. The result is the current course through the winding of the injection valve as shown in FIG. 2*e*.

Figure 4:
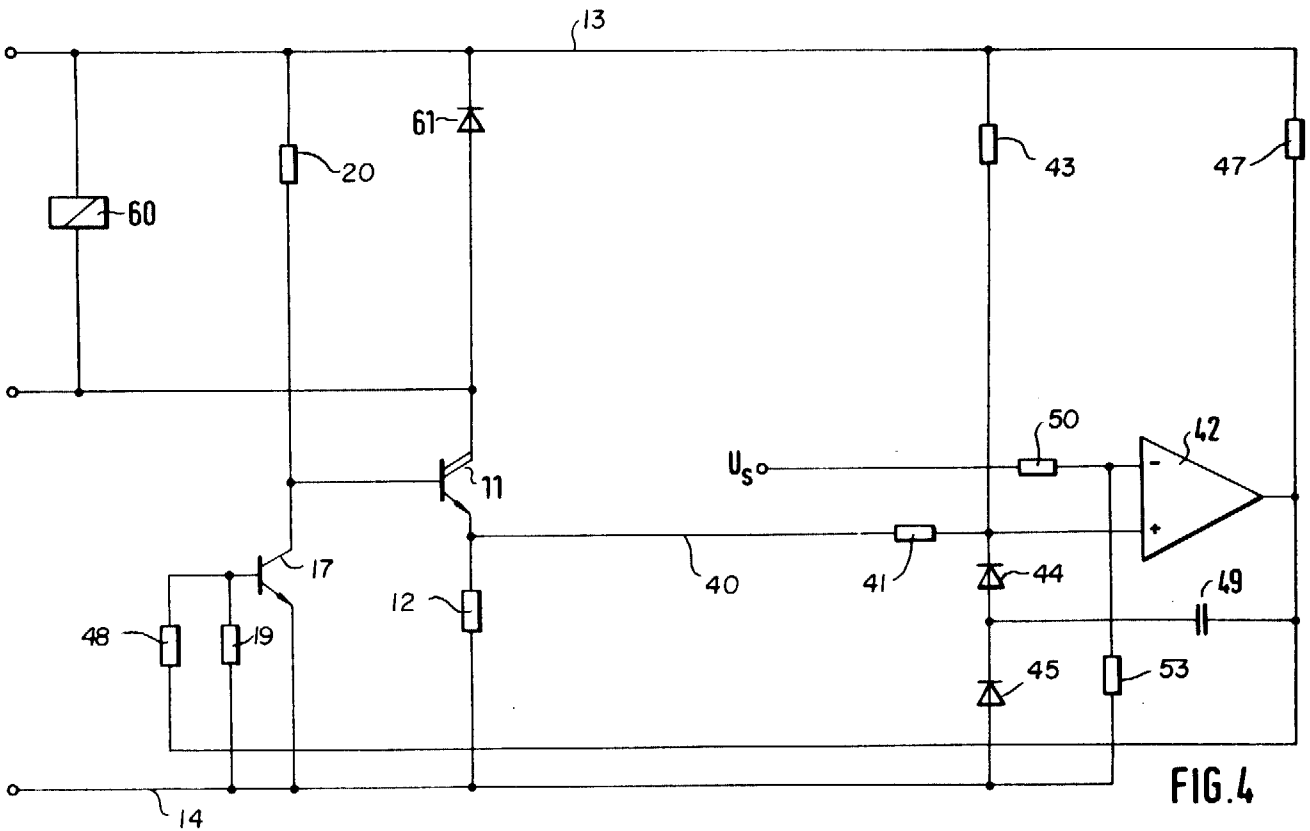
FIG. 4 shows a control device for an adjusting magnet; and finally.

In the subject of FIG. 4, the signal behavior of the control device of FIG. 2 is utilized during the period of an injection signal for controlling an electromechanical final control element as to its position. Such final control elements are required in combination with engine control means, for instance in the context of regulating idling in engines having externally supplied ignition, or are used for controlling the position of a quantity-determining member in an injection pump for a Diesel engine.

In the subject of FIG. 4, the magnetic winding 60 of a final control element is continuously exposed to a pulsating current. The arithmetical average value of this current can be adjusted in this control device via a control signal $U_s$ at the negative input of the comparator 42.

The control device of FIG. 4 corresponds in principle to the control device of FIG. 1. However, the free-running control circuit 22 is omitted because during the blocked periods of the transistor 11, a simple free-running diode 61 suffices to conduct the free-running current. The control voltage $U_s$ at the negative input of the comparator 42 determines the maximal value through the winding 60 of the final control element. The duration of the various free-running phases orients itself to the switchover time constants for the capacitor 49, as already explained using the example of the control of the injection valve.

Figure 5:
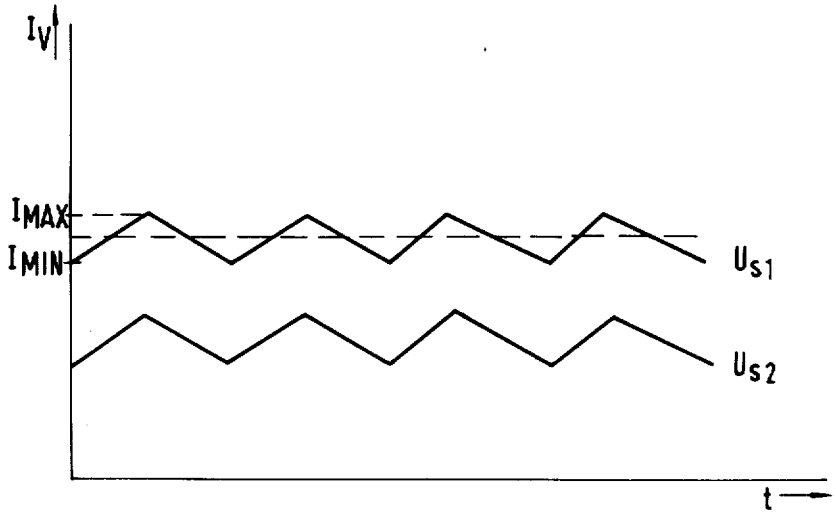
FIG. 5 is a pulse diagram for the control device shown in FIG. 4.

The current diagram associated with the control device of FIG. 4 is shown in FIG. 5 for two different control voltages $U_s$. The diagram shows the constant alternation between a current increase, caused by the switching transistor 11 which has been made conductive, and a subsequent current decrease, caused by the ohmic resistors in the free-running circuit having the diode 61.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A control device for an electromagnetic consumer means for use in fuel regulation in internal combustion engines comprising, a switching transistor located in series with said consumer means, a current measuring resistor connected with a comparison stage means for switching said switching transistor into its blocked state upon attaining a predetermined consumer current and switching said switching transistor back into its conductive state in accordance with time, and said comparison stage means having a capacitive dynamic positive feedback means for controlling the duration of said time.

2. A control device as defined by claim 1, wherein said capacitive dynamic positive feedback means comprises a series circuit of a capacitor and a diode, and the junction therebetween being coupled by means of a diode connected to a battery voltage line.

3. A control device as defined by claim 1 or 2, further comprising a free-running control circuit means for triggering intermittently said consumer means having at least one transistor, and a diode means connected in parallel with said transistor.

4. A control device as defined by claim 3, wherein said freerunning control circuit means is controllable in a time-synchronized manner producing a signal switching said consumer "ON".

5. A control device as defined by claim 3, wherein said diode means comprises a Zener diode in parallel with said transistor.

6. A control device as defined by claim 2, further comprising, a compensation network means for compensating the variations in the reference voltage to thereby enable a linear opening duration of said consumer means via said battery voltage.

* * * * *